US012692690B1

(12) United States Patent
Huang et al.

(10) Patent No.: US 12,692,690 B1
(45) Date of Patent: Jul. 28, 2026

(54) VENTILATION CONNECTOR AND EXHAUST FLANGE

(71) Applicant: Wei Huang, Irvine, CA (US)

(72) Inventors: Wei Huang, Irvine, CA (US); Hexu Huang, Irvine, CA (US); Bangxiang Huang, Hubei (CN)

(73) Assignee: Wei Huang, Irvine, CA (US)

( * ) Notice: Subject to any disclaimer, the term of this patent is extended or adjusted under 35 U.S.C. 154(b) by 0 days.

(21) Appl. No.: 19/263,540

(22) Filed: Jul. 9, 2025

(30) Foreign Application Priority Data

May 21, 2025 (CN) ..... 202521007728.7

(51) Int. Cl.
*E03D 9/052* (2006.01)
*E03D 11/16* (2006.01)

(52) U.S. Cl.
CPC ..... *E03D 9/052* (2013.01); *E03D 11/16* (2013.01)

(58) Field of Classification Search
CPC ..... A47K 13/307; E03D 9/05; E03D 9/052; E03D 11/16
See application file for complete search history.

(56) References Cited

U.S. PATENT DOCUMENTS 3,122,757 A * 3/1964 Sowards ..... E03D 9/052 4/213
3,287,743 A * 11/1966 Coates ..... E03D 9/052 4/213
5,386,594 A * 2/1995 Hilton ..... E03D 11/16 4/213
9,228,335 B2 * 1/2016 Quick ..... E03D 9/052
12,065,818 B2 * 8/2024 Wilson ..... E03D 11/16

* cited by examiner

*Primary Examiner* — Erin Deery
(74) *Attorney, Agent, or Firm* — Hemisphere Law, PLLC

(57) ABSTRACT

The present invention relates to a ventilation connector and an exhaust flange. The ventilation connector includes a main body and a connecting body. The main body has a first passage. The connecting body protrudes from a side of the main body and includes a base and a reinforcing body projecting from an edge of the base, the base has a second passage in communication with the first passage, and the second passage is configured to be in communication to a toilet sewage pipe. In an axial direction of the main body, a thickness of at least a part of the reinforcing body is smaller than that of the base. The connecting body is configured to be inserted into an exhaust passage of the exhaust flange, and a shape of the exhaust passage matches shapes of the base and the reinforcing body.

6 Claims, 13 Drawing Sheets

VENTILATION CONNECTOR AND EXHAUST FLANGE

TECHNICAL FIELD

The invention relates to the field of toilet fitting technologies, and in particular, to a ventilation connector and an exhaust flange.

BACKGROUND

In the related art, in order to reduce odors generated during use of a toilet, the odors in the toilet can be guided into a toilet sewage pipe through a pipe. As disclosed in Patent CN222275693U, an exhaust flange is installed at a toilet sewage outlet, and the pipe is in communication with the exhaust flange through a ventilation bolt, thereby discharging the odors in a toilet bowl into the toilet sewage pipe. In such implementations, the structural strength at a connection between the exhaust flange and the ventilation bolt is difficult to ensure.

SUMMARY OF THE PRESENT INVENTION

Embodiments of the present invention provide a ventilation connector and an exhaust flange to address the above-mentioned issues.

In a first aspect, the present application discloses a ventilation connector, including:

a main body having a first passage; and a connecting body protruding from a side of the main body and including a base and a reinforcing body projecting from an edge of the base, wherein the base has a second passage in communication with the first passage, and the second passage is configured to be in communication to a toilet sewage pipe; in an axial direction of the main body, a thickness of at least a part of the reinforcing body is smaller than that of the base; the connecting body is configured to be inserted into an exhaust passage of an exhaust flange, and a shape of the exhaust passage matches shapes of the base and the reinforcing body.

In a second aspect, the present application discloses an exhaust flange, having a sewage passage and an exhaust passage, wherein the sewage passage is configured to be in communication with a toilet sewage outlet, the exhaust passage is configured to guide gases into a toilet sewage pipe and to accommodate insertion of a ventilation connector, and includes a first mounting groove and a second mounting groove that are in communication with each other, and the second mounting groove is located at an edge of the first mounting groove along a width direction; in an axial direction of the exhaust flange, a flange wall thickness at the second mounting groove is greater than that at the first mounting groove, a shape of the first mounting groove matches that of a base of the ventilation connector, and a shape of the second mounting groove matches that of a reinforcing body of the ventilation connector.

In a third aspect, the present application discloses an exhaust flange, including a body and a pipe connector which are integrally formed, wherein the body has a sewage passage configured to be in communication with a toilet sewage outlet, and the exhaust flange also has an exhaust passage extending from the pipe connector to the body and configured to guide gases into a toilet sewage pipe.

BRIEF DESCRIPTION OF THE DRAWINGS

To provide a clearer understanding of the technical solutions in the embodiments or the prior art of the present invention, a brief description of the accompanying drawings used in the embodiments or the prior art is given below. It is evident that the drawings described below illustrate only some embodiments of the invention, and those skilled in the art may derive other drawings based on these without involving inventive efforts.

DETAILED DESCRIPTION OF THE PREFERRED EMBODIMENT

Figure 1:
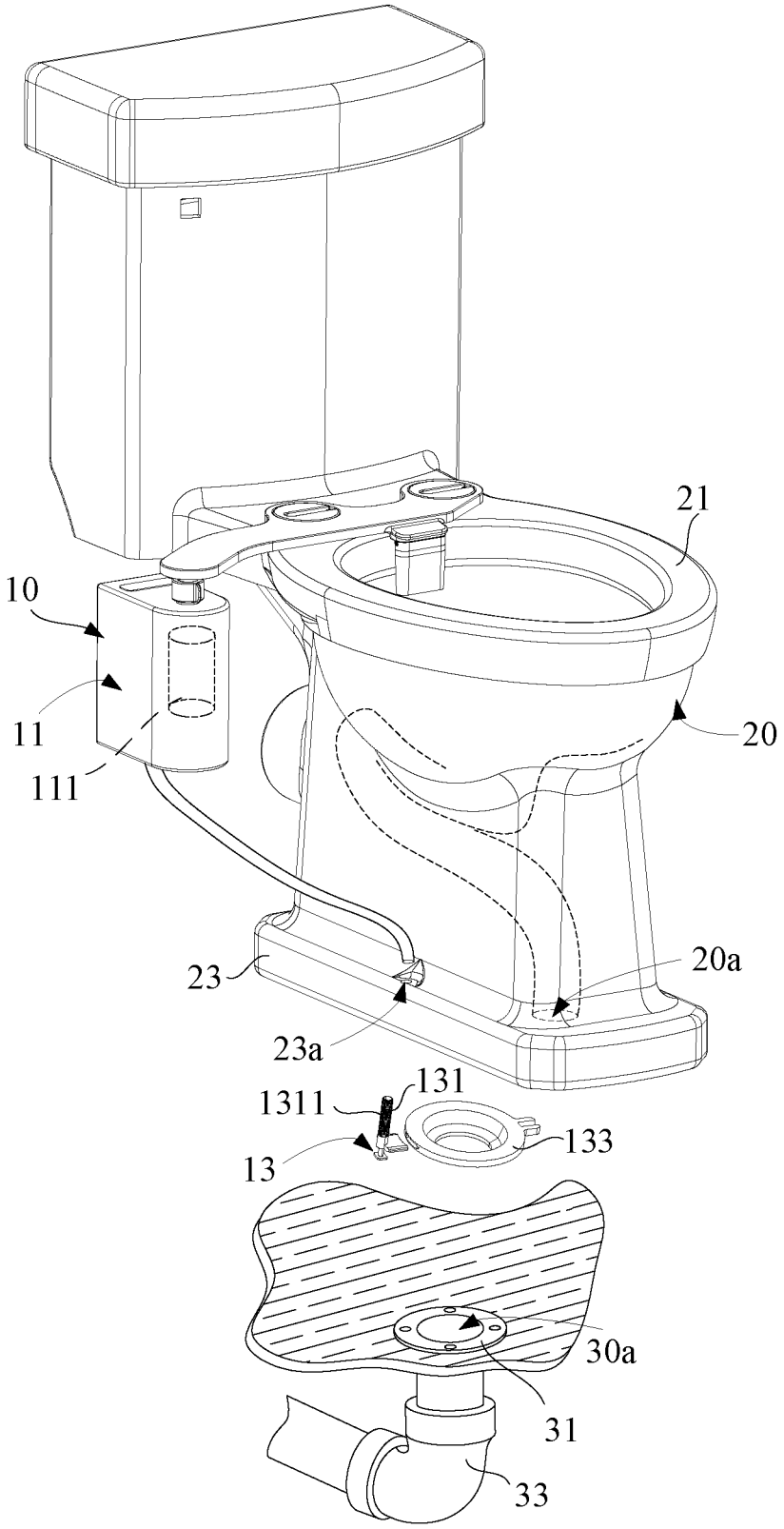
FIG. 1 is an exploded view of a fit of a toilet deodorization device and a toilet in a first embodiment.

The following detailed description of the preferred embodiments is the preferred way of implementing the present invention. This description should not be considered as restrictive. It is presented to illustrate the general principles of the invention.

It should be understood that the terms "mounting," "connecting," "coupling," and "assembling" used in the following description refer to the connection relationships shown in the drawings for ease of understanding the present invention. For example, "connecting" can refer to either a permanent or detachable connection. Additionally, "connection" can be direct or indirect, or through other auxiliary components. Therefore, these terms should not be considered as limiting the actual connections of the elements of the present invention.

It should be understood that the terms "length," "width," "top," "bottom," "front," "rear," "left," "right," "vertical," "horizontal," "up," "down," "outside," and "inside" used in the following description refer to the directional or positional relationships shown in the drawings for ease of understanding the present invention, and do not limit the actual position or direction of the present invention. Therefore, these terms should not be considered as limiting the actual positions of the elements of the present invention.

It should be understood that the terms "first," "second," "one," "a," and "an" used in the following description refer to "at least one" or "one or more" in the embodiments. Specifically, "one" in one embodiment may refer to "one," while in another embodiment, it may refer to "more than one." Therefore, these terms should not be considered as limiting the actual number of the elements of the present invention.

First Embodiment

Referring to FIG. 1, a first embodiment of the present application discloses a toilet deodorization device 10, which includes a suction mechanism 11 and a ventilation and drainage assembly 13. The suction mechanism 11 can be mounted on a toilet bowl 21 of a toilet 20. The suction mechanism 11 may include a fan assembly 111 which can be in communication to the toilet bowl 21 through a hollow pipe or another hollow attachment, thus enabling air to flow between the toilet bowl 21 and the fan assembly 111. The ventilation and drainage assembly 13 is arranged between a toilet sewage outlet 20*a* and a sewage passage 30*a*, and is in communication to the fan assembly 111. That is, the air can flow between the ventilation and drainage assembly 13 and the fan assembly 111. The fan assembly 111 may include a motor which, when in operation, can induce airflow to draw the air from the toilet bowl 21 and guide it into the sewage passage 30*a* through the ventilation and drainage assembly 13, thereby expelling odors in the toilet bowl 21 into the sewage passage 30*a* and preventing the odors in the toilet 20 from spreading into a restroom. It should be understood that in some implementations, the suction mechanism 11 may be integrated into a toilet lid or other parts of the toilet 20. In such implementations, the toilet lid or other parts of the toilet 20 with a deodorizing function may be considered as at least a part of the toilet deodorization device 10.

Figure 2:
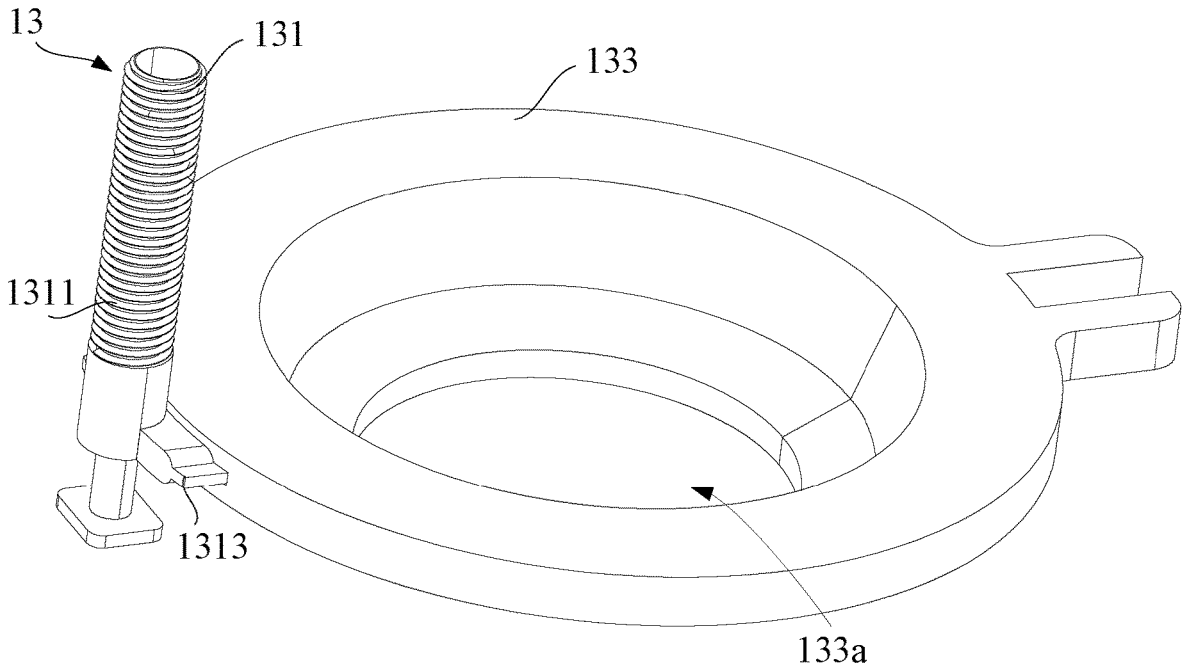
FIG. 2 is a schematic diagram of a ventilation and drainage assembly of the toilet deodorization device in the first embodiment.
Figure 3:
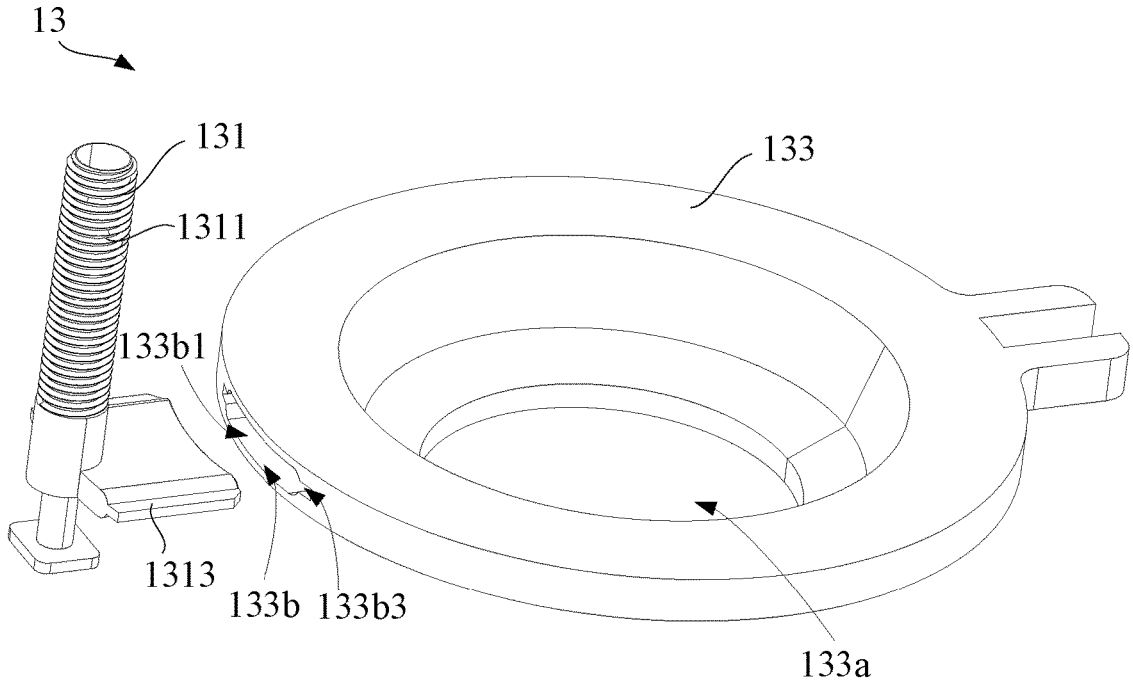
FIG. 3 is an exploded view of the ventilation and drainage assembly shown in FIG. 2.
Figure 4:
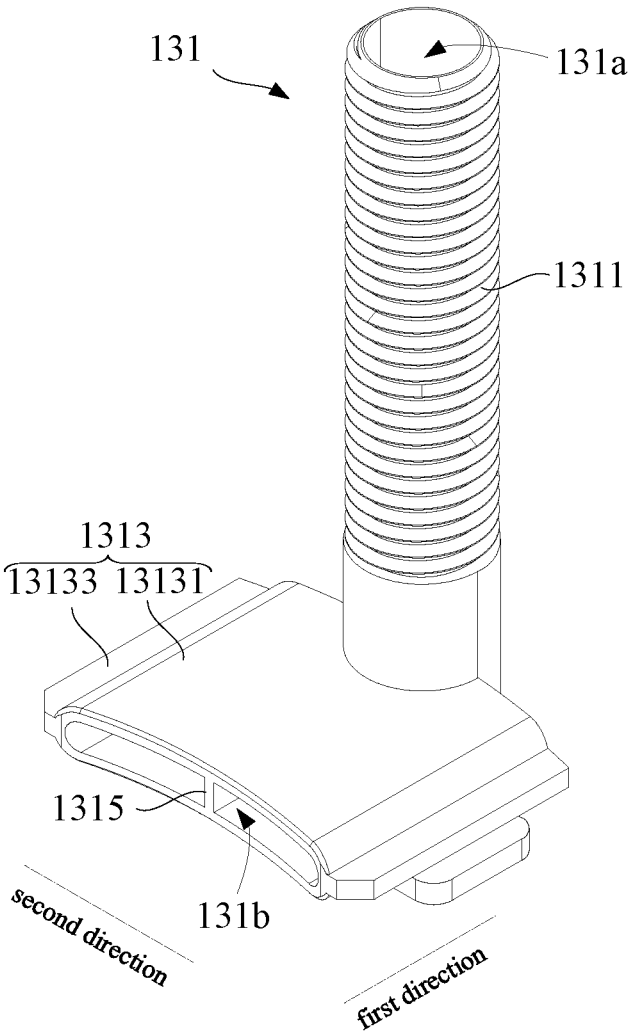
FIG. 4 is a schematic diagram of a ventilation connector of the ventilation and drainage assembly shown in FIG. 3.
Figure 5:
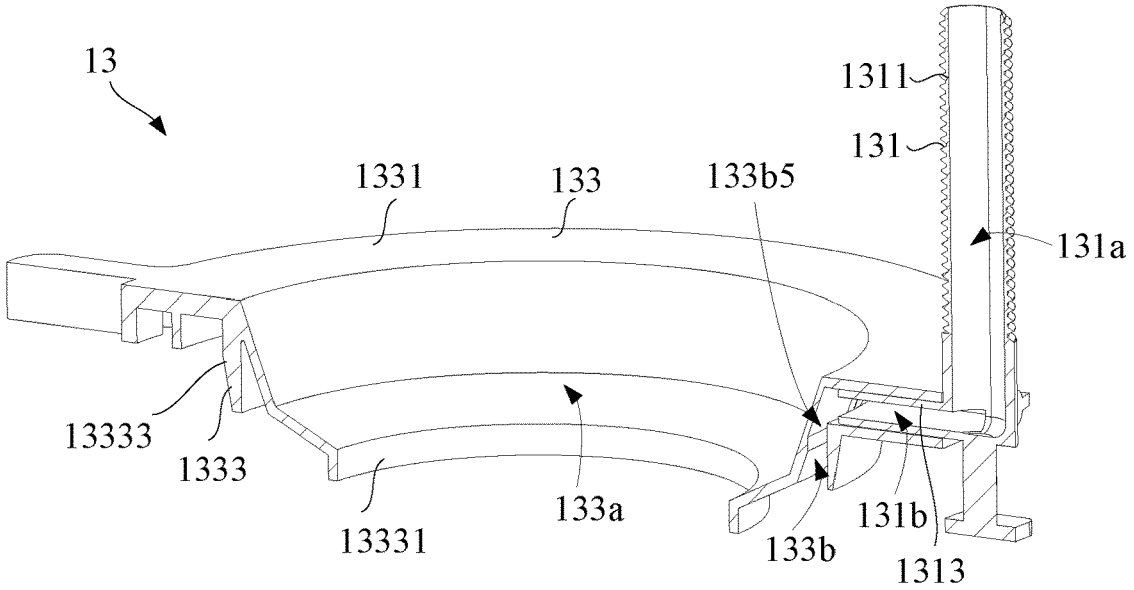
FIG. 5 is a sectional view of the ventilation and drainage assembly of the toilet deodorization device shown in FIG. 2.

Referring to FIGS. 2 and 3, the ventilation and drainage assembly 13 includes a ventilation connector 131 and an exhaust flange 133. Referring also to FIGS. 4 and 5, the ventilation connector 131 includes a main body 1311 and a connecting body 1313. The main body 1311 is approximately cylindrical and has a first passage 131*a* which may be in communication to the fan assembly 111. Exemplarily, the first passage 131*a* extends along an axial direction of the main body 1311. In some implementations, the main body 1311 has external threads and may be inserted through a toilet mounting hole 23*a* of a toilet base 23 (see FIG. 1). The external threads are configured to cooperate with external nuts and gaskets or other accessories to securely fix the ventilation connector 131 to the toilet mounting hole 23*a*. An end portion of the ventilation connector 131 opposite to the main body 1311 can be mounted into a toilet flange 31 of the toilet 20 (see FIG. 1), thereby enhancing fixation of the toilet 20 to the ground or floor. In other implementations, the main body 1311 may have internal threads.

Certainly, the external or internal threads of the main body 1311 are not mandatory and may be omitted. For example, an outer side of the main body 1311 may be a smooth cylindrical surface, and the main body 1311 may also be provided with other structures for being connected to ventilation pipes, such as a pagoda joint or a quick connector.

Referring to FIG. 4, the connecting body 1313 is approximately a hollow block, protrudes from a side of the main body 1311 and includes a base 13131 and a reinforcing body 13133 projecting from an edge of the base 13131. The base 13131 has a second passage 131*b* in communication with the first passage 131*a* and is configured to be in communication to a toilet sewage pipe 33 (see FIG. 1). In an axial direction of the main body 1311, at least a part of the reinforcing body 13133 has a smaller thickness than the base 13131. Further, in some implementations, the ventilation connector 131 may have a first direction and a second direction perpendicular to each other, both being perpendicular to the axial direction of the main body 1311. The connecting body 1313 protrudes from the main body 1311 in the first direction. In the second direction, the reinforcing bodies 13133 are convexly provided on two opposite sides of the base 13131.

Moreover, the base 13131 and the reinforcing bodies 13133 may be arranged in mirror symmetry relative to a central plane of the main body 1311, which lies in the same plane as an axis of the main body 1311 and is perpendicular to the second direction. Further, in some implementations, in the second direction, the base 13131 is wider than the main body 1311, and the base 13131 for defining the second passage 131*b* may have a relatively uniform wall thickness. Reinforcing ribs 1315 integrally formed with the base 13131 may be provided inside the second passage 131*b* to enhance the structural stability of the base 13131 and prevent deformation of the connecting body 1313 during assembly or use.

Figure 6:
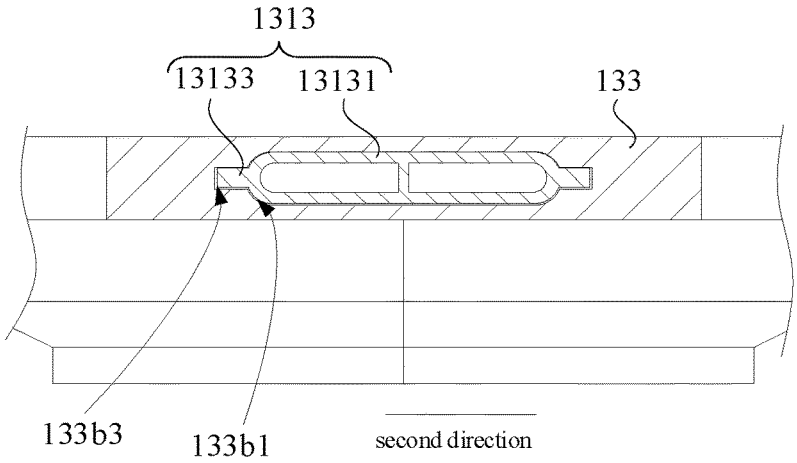
FIG. 6 is a partial sectional view of one implementation of the ventilation and drainage assembly in the first embodiment.
Figure 7:
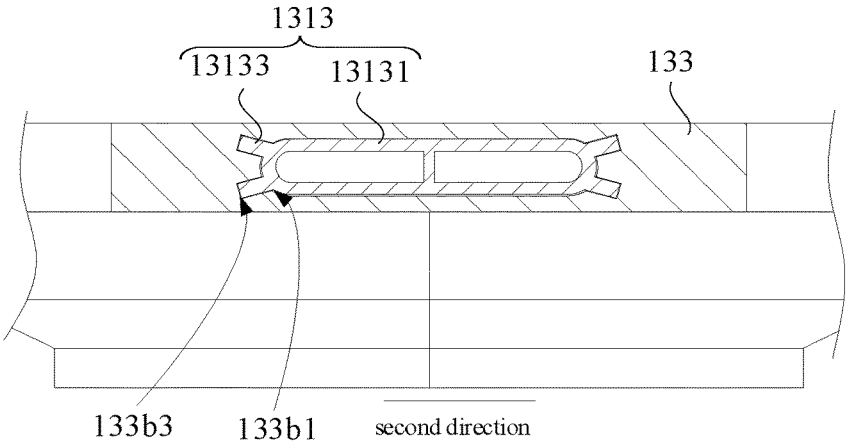
FIG. 7 is a partial sectional view of another implementation of the ventilation and drainage assembly in the first embodiment.

Referring to FIG. 6, in some implementations, the reinforcing body 13133 extends in the second direction along the width of the base 13131. Referring to FIG. 7, in other implementations, the reinforcing body 13133 may extend linearly at an angle relative to the second direction. Certainly, in other implementations, the reinforcing body 13133 may have additional variants.

With continued reference to FIG. 3 and in conjunction with FIG. 5, the exhaust flange 133 has a sewage passage 133*a* and an exhaust passage 133*b*. The sewage passage 133*a* is configured to be in communication to the toilet sewage outlet 20*a*, and the exhaust passage 133*b* is configured to guide gases into the toilet sewage pipe 33. The exhaust passage 133*b* is configured to accommodate insertion of the connecting body 1313 of the ventilation connector 131 and includes a first mounting groove 133*b*1 and a second mounting groove 133*b*3 that are in communication with each other. The second mounting groove 133*b*3 is located at an edge of the first mounting groove 133*b*1 in a width direction. In an axial direction of the exhaust flange 133, a flange wall thickness at the second mounting groove 133*b*3 is larger than that at the first mounting groove 133*b*1. A shape of the first mounting groove 133*b*1 matches that of the base 13131 of the ventilation connector 131, and a shape of the second mounting groove **133*b*3 matches that of the reinforcing body 13133 of the ventilation connector 131**.

Further, in order to accommodate the structure in which the reinforcing bodies 13133 are convexly provided on the two opposite sides of the base 13131, the second mounting grooves **133*b*3 are respectively formed on both side edges of the first mounting groove 133*b*1 in the width direction. Exemplarily, after the ventilation connector 131 is inserted into the exhaust flange 133, the axis of the main body 1311 may be substantially parallel to an axis of the exhaust flange 133, and the second mounting grooves 133*b*3 are distributed on two opposite edges of the first mounting groove 133*b*1** along the second direction.

In the above-described ventilation and drainage assembly 13, since in the axial direction of the exhaust flange 133, the flange wall thickness at the second mounting groove **133*b*3 is larger than that at the first mounting groove 133*b*1, the shape of the first mounting groove 133*b*1 matches that of the base 13131 of the ventilation connector 131, and the shape of the second mounting groove 133*b*3 matches that of the reinforcing body 13133 of the ventilation connector 131, the fit between the second mounting groove 133*b*3 and the reinforcing body 13133 can better share the stress at a connection between the ventilation connector 131 and the exhaust flange 133**, thereby improving the structural strength of their connection.

In some implementations, the fit between the base 13131 and the first mounting groove **133*b*1 and the fit between the reinforcing body 13133 and the second mounting groove 133*b*3 may be a transitional fit to enable a tight fit between the connecting body 1313 and the exhaust flange 133 and prevent air leakage at the connection between the connecting body 1313 and the exhaust flange 133 during operation of the toilet deodorization device 10, thus avoiding odor diffusion. Certainly, in other embodiments, the fit between the base 13131 and the first mounting groove 133*b*1 and the fit between the reinforcing body 13133 and the second mounting groove 133*b*3 can be a clearance fit. Sealing connection between the connecting body 1313 and the exhaust flange 133 can also be achieved by sleeving the connecting body 1313 with a sealing ring or sealing tape, or by applying sealant to an outer surface of the connecting body 1313, so as to prevent the air leakage at the connection between the connecting body 1313 and the exhaust flange 133 during the operation of the toilet deodorization device 10**, thus avoiding the odor diffusion.

Figure 8:
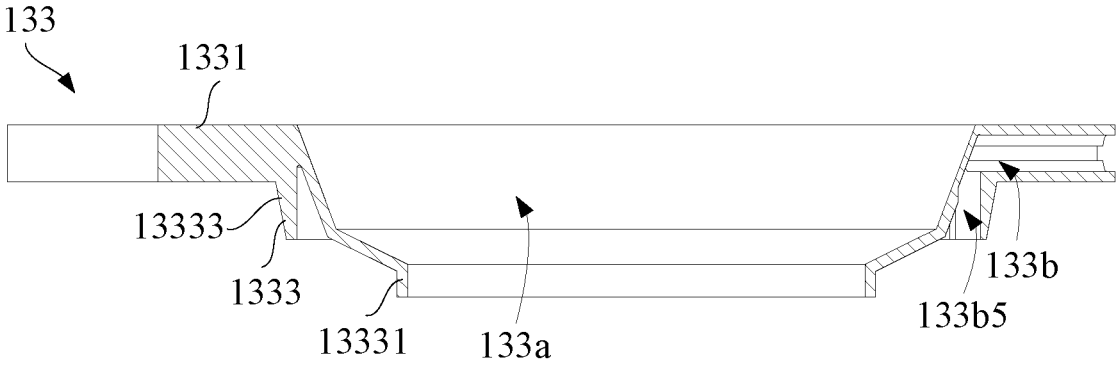
FIG. 8 is a sectional view of a first type of exhaust flange of the ventilation and drainage assembly in the first embodiment.

Referring to FIG. 8 and in conjunction with FIG. 5, the exhaust flange 133 may include a flange body 1331 and an extension portion 1333 convexly arranged on one side of the flange body 1331. That is, the extension portion 1333 is convexly arranged on one axial side of the flange body 1331. The flange body 1331 is approximately annular, and the extension portion 1333 may be cylindrical and coaxially arranged with the flange body 1331. The flange body 1331 and the extension portion 1333 can be integrally formed, for example by injection molding. Along the axial direction of the exhaust flange 133, the sewage passage **133*a* extends from the flange body 1331 to the extension portion 1333. The flange body 1331 can be docked with the toilet sewage outlet 20*a*, and the extension portion 1333 can be docked to the toilet sewage pipe 33, thereby allowing sewage to be smoothly discharged from the toilet sewage outlet 20*a* through the sewage passage 133*a* into the toilet sewage pipe 33. Certainly, in other embodiments, the shapes of the flange body 1331 and the extension portion 1333** can be adaptively adjusted according to mounting requirements.

The first mounting groove **133*b*1 and the second mounting groove 133*b*3 are formed in a circumferential side of the flange body 1331. The exhaust passage 133*b* includes an exhaust groove 133*b*5 in communication to the first mounting groove 133*b*1 and the second mounting groove 133*b*3. The exhaust groove 133*b*5 extends to a side of the extension portion 1333 opposite to the flange body 1331. That is, the exhaust groove 133*b*5 extends to one axial side of the extension portion 1333. Taking the annular flange body 1331 as an example, the first mounting groove 133*b*1 and the second mounting groove 133*b*3 are formed in an outer cylindrical surface of the flange body 1331 and extend toward the sewage passage 133*a*, that is, along a radial direction of the flange body 1331. The exhaust groove 1335 then extends to the side of the extension portion 1333 opposite to the flange body 1331. In other words, after the exhaust flange 133 is assembled to the toilet sewage pipe 33, the exhaust groove 133*b*5 is located on a side of the flange body 1331 opposite to the toilet sewage outlet 20*a***.

Figure 9:
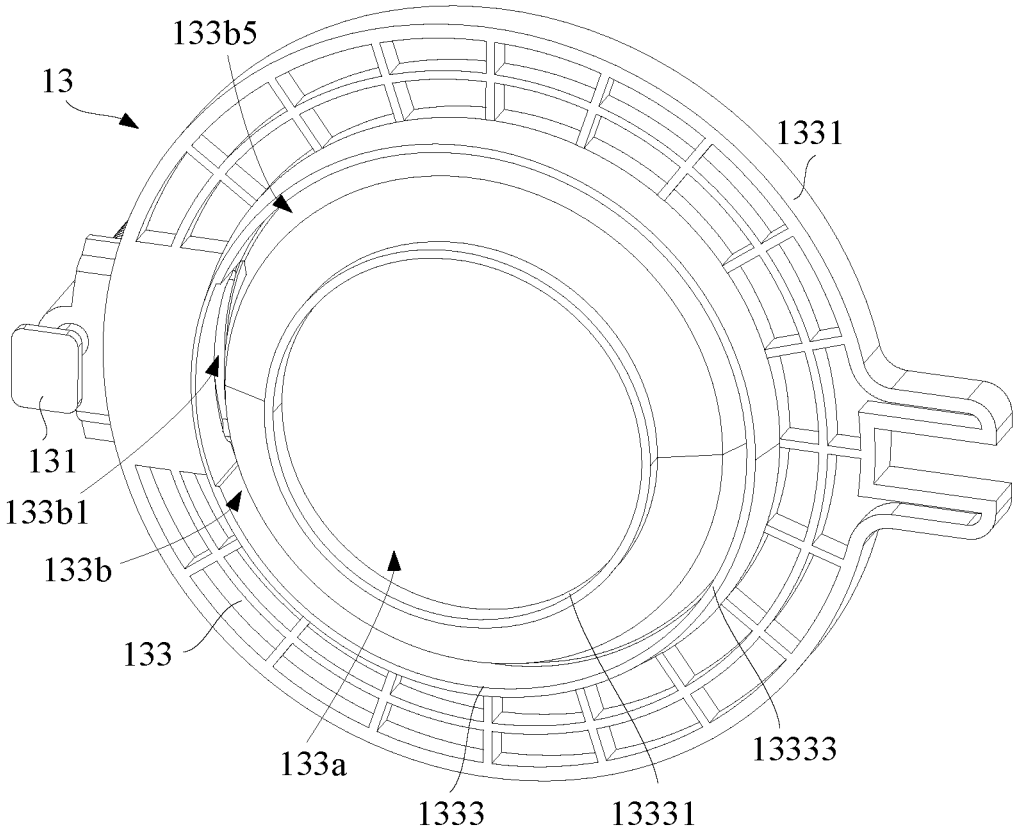
FIG. 9 is a schematic diagram of the ventilation and drainage assembly shown in FIG. 2 from another perspective.

Further, in some implementations, the exhaust groove **133*b*5 is spaced apart from the sewage passage 133*a* to prevent sewage from the toilet sewage outlet 20*a* from easily entering the first mounting groove 133*b*1 and the second mounting groove 133*b*3. In conjunction with FIG. 9, a central angle corresponding to the exhaust groove 133*b*5 is not less than that corresponding to the first mounting groove 133*b*1. As shown in FIG. 9, the central angle of the exhaust groove 133*b*5 is 360 degrees, that is, it encircles an axis of the sewage passage 133*a*. In other implementations, the central angle corresponding to the exhaust groove 133*b*5** may be 90 degrees, 120 degrees, 180 degrees, etc.

Taking the implementations shown in FIGS. 8 and 9 as examples, the extension portion 1333 may include an inner ring 13331 connected to the flange body 1331 and an outer ring 13333. The outer ring 13333 surrounds the inner ring 13331, and the outer ring 13333 and the inner ring 13331 define the exhaust groove **133*b*5. The outer ring 13333 and the inner ring 13331 may be approximately annular and define the annular exhaust groove 133*b*5. That is, the central angle of the exhaust groove 133*b*5** is 360 degrees.

In implementations where the central angle of the exhaust groove **133*b*5 is less than 360 degrees, a corresponding part of the exhaust groove 133*b*5 forms a recessed groove structure in communication with the first mounting groove 133*b*1 and the second mounting groove 133*b*3. Other parts may maintain an integrated structure, and a distinction between the inner ring 13331 and the outer ring 13333** may not be necessary.

In the implementations shown in FIGS. 8 and 9, the inner ring 13331 slightly protrudes beyond the outer ring 13333 along the axial direction of the exhaust flange 133. In other implementations, ends of the inner ring 13331 and the outer ring 13333 away from the flange body 1331 may be flush. In conjunction with FIG. 1, a toilet mounting flange 31 is arranged on the toilet sewage pipe 33. The exhaust flange 133 can be docked onto the toilet mounting flange 31 which is fixedly connected to the mounting ground. A sealing gasket can be provided between the exhaust flange 133 and the toilet mounting flange 31. A part of the ventilation connector 13 connected to the exhaust flange 133 can be placed into and clamped into a clamping groove in the toilet mounting flange 31.

It may be understood that the structure of the exhaust groove **133*b*5 is not limited to the structure described above. The side of the extension portion 1333 opposite to the flange body 1331 or a side of the exhaust flange 133 opposite to the toilet sewage outlet 20*a*** is provided with the exhaust groove 133*b*5 in communication with the first mounting groove 133*b*1 and the second mounting groove 133*b*3. The exhaust groove 133*b*5 is isolated from the sewage passage 133*a*. After the ventilation connector 131 and the exhaust flange 133 are assembled, the air in the toilet bowl 21 can be guided through the first passage 131*a* and the second passage 131*b* of the ventilation connector 131 and the exhaust groove 133*b*5 of the exhaust flange 133 into the toilet sewage pipe 33, thereby achieving odor discharging.

Figure 10:
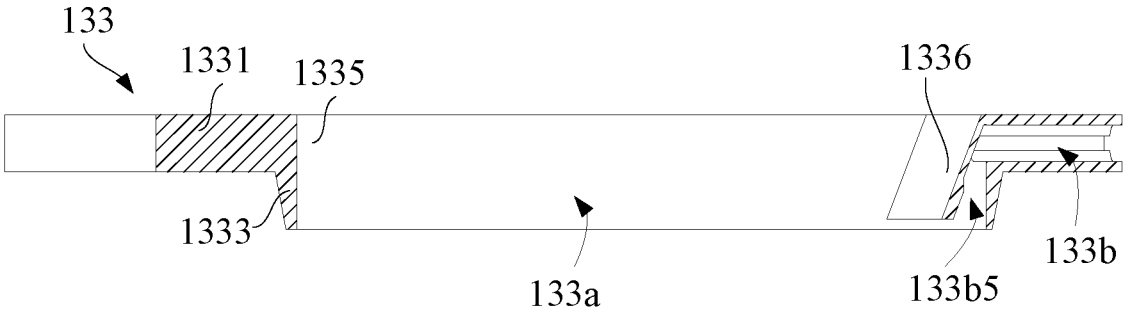
FIG. 10 is a sectional view of a second type of exhaust flange of the ventilation and drainage assembly in the first embodiment.

Certainly, the exhaust groove 133*b*5 can also have other modified structures. Referring to FIG. 10, exemplarily, the exhaust flange 133 has a side wall 1335 for defining the sewage passage 133*a*, and a blocking portion 1336 connected to the side wall 1335. The blocking portion 1336 is configured to prevent the sewage from entering the exhaust passage 133*b*. Specifically, the exhaust passage 133*b* can extend through the flange body 1331, and the blocking portion 1336 is arranged at a position corresponding to an outlet of the exhaust passage 133*b* on an inner side of the flange body 1331. The blocking portion 1336 may protrude from the side wall 1335 of the sewage passage 133*a* to prevent the sewage of the toilet sewage outlet 20*a* from easily entering the exhaust passage 133*b*. Certainly, in some variant implementations, the exhaust passage 133*b* may extend from a side of the flange body 1331 through the extension portion 1333, and the blocking portion 1336 is arranged at a position corresponding to an outlet of the exhaust passage 133*b* on an inner side of the extension portion 1333 to prevent the sewage of the toilet sewage outlet 20*a* from easily entering the exhaust passage 133*b*.

Figure 11:
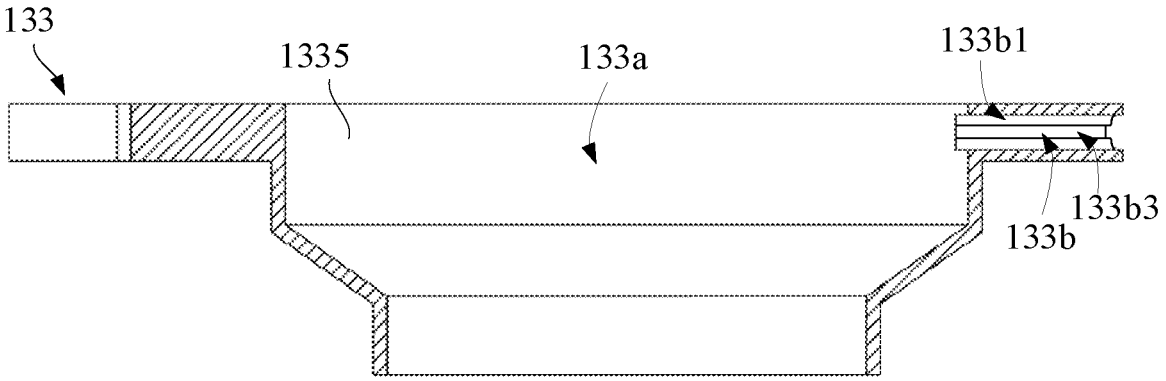
FIG. 11 is a sectional view of a third type of exhaust flange of the ventilation and drainage assembly in the first embodiment.

Referring to FIG. 11, in other implementations, the exhaust flange 133 has a side wall 1335 for defining the sewage passage 133*a*. The first mounting groove 133*b*1 and the second mounting groove 133*b*3 are formed in a circumferential side of the exhaust flange 133. The exhaust passage 133*b* extends from the circumferential side of the exhaust flange 133 to the side wall 1335, so as to be in communication with the sewage passage 133*a*. In other words, in this implementation, the exhaust passage 133*b* does not need to be spaced apart from the sewage passage 133*a* of the exhaust flange 133, and no blocking portion 1336 is necessary. The air in the toilet bowl 21 can directly flow through the first passage 131*a* and the second passage 131*b* of the ventilation connector 131 and the exhaust passage 133*b* into the sewage passage 133*a*. This structure can simplify the structure of the exhaust passage 133*b* of the exhaust flange 133, facilitates manufacturing and molding of the exhaust flange 133, and is one of applicable solutions.

Second Embodiment

Figure 12:
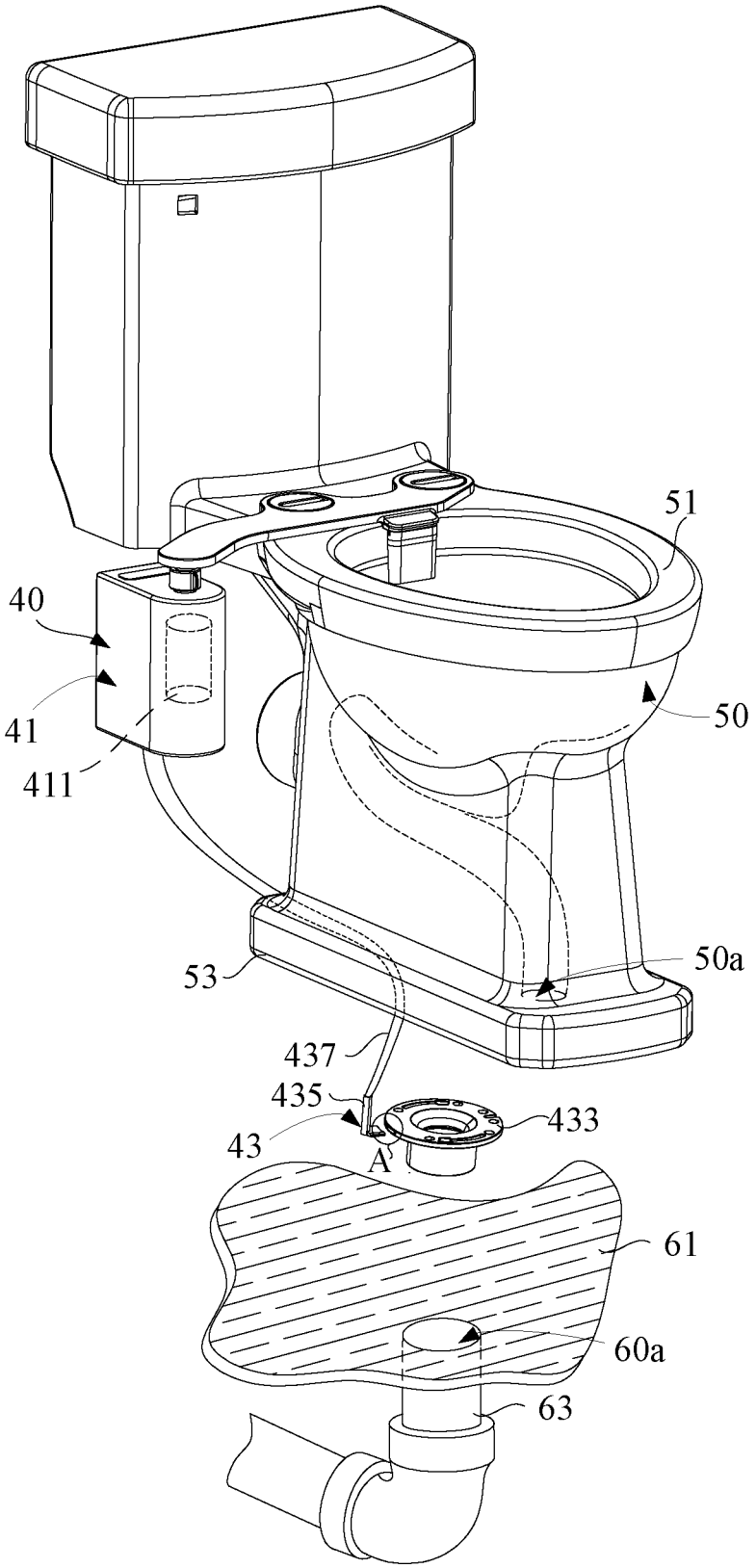
FIG. 12 is an exploded view of a fit of a toilet deodorization device and a toilet in a second embodiment.

Referring to FIG. 12, a second embodiment of the present application discloses a toilet deodorization device 40, which includes a suction mechanism 41 and a ventilation and drainage assembly 43. The suction mechanism 41 can be mounted on a toilet bowl 51 of a toilet 50. The suction mechanism 41 includes a fan assembly 411 which can be in communication to the toilet bowl 41 through a hollow pipe or another hollow attachment, thus enabling air to flow between the toilet bowl 51 and the fan assembly 411. The ventilation and drainage assembly 43 is arranged between a toilet sewage outlet 50*a* and a sewage passage 60*a*, and is in communication to the fan assembly 411. That is, the air can flow between the ventilation and drainage assembly 43 and the fan assembly 411. The fan assembly 411 may include a motor which, when in operation, can induce airflow to draw the air from the toilet bowl 51 and guide it into the sewage passage 60*a* through the ventilation and drainage assembly 43, thereby expelling odors in the toilet bowl 51 into the sewage passage 60*a* and preventing the odors in the toilet 50 from spreading into a restroom. It should be understood that in some implementations, the suction mechanism 41 may be integrated into a toilet lid or other parts of the toilet 50. In such implementations, the toilet lid or other parts of the toilet 50 with a deodorizing function may be considered as at least a part of the toilet deodorization device 40.

Figure 13:
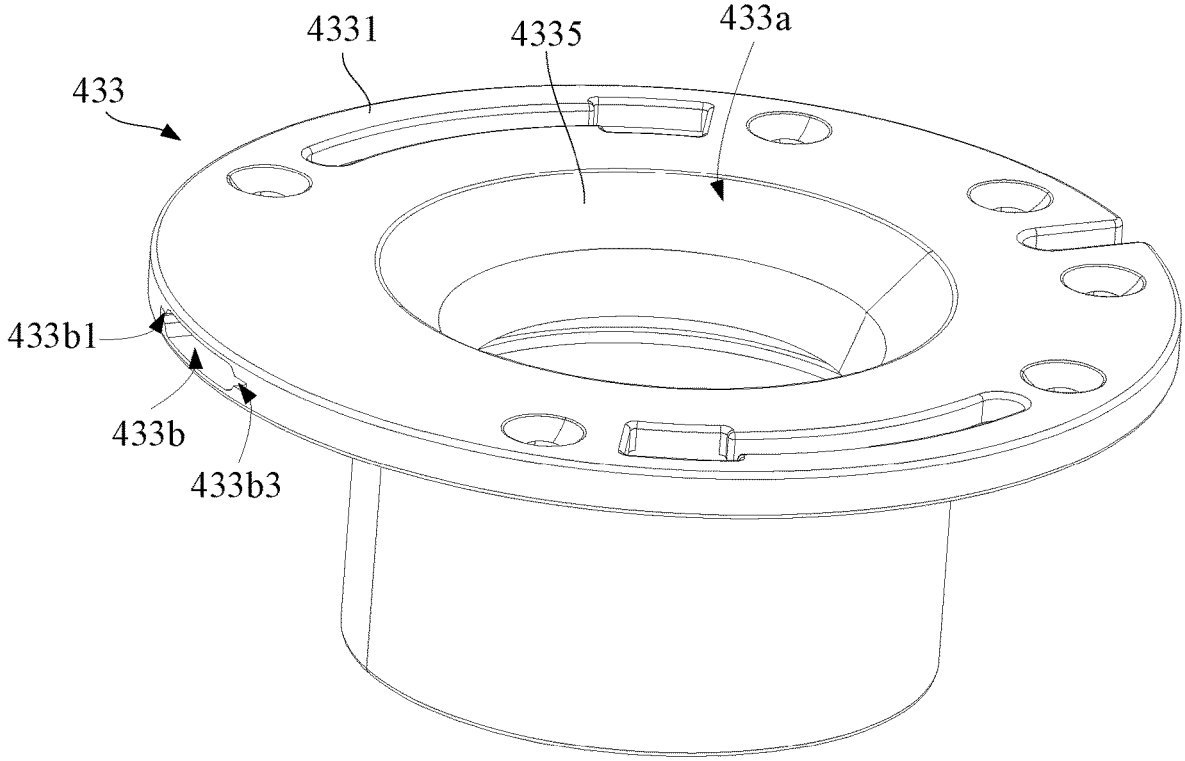
FIG. 13 is a schematic diagram of a first type of exhaust flange of a ventilation and drainage assembly of the toilet deodorization device shown in FIG. 12.

The ventilation and drainage assembly 43 in the second embodiment may also include an exhaust flange 433 and a ventilation connector 435 connected to the exhaust flange 433. In conjunction with FIGS. 13 and 14, reference may be made to the description of the first embodiment for the structure of the exhaust flange 433 which has a sewage passage 433*a* for being in communication with the toilet sewage outlet 50*a* and an exhaust passage 433*b* for air exhausting.

The exhaust flange 433 may have a first mounting groove 433*b*1 and a second mounting groove 433*b*3 similar to those in the first embodiment and configured to insert the ventilation connector 435. In conjunction with FIG. 15, the ventilation connector 435 has an air passage 435*a*. One end of a ventilation pipe 437 is fixedly connected to the ventilation connector 435 and is in communication to the exhaust passage 433*b* through the air passage 435*a*. The ventilation connector 435 includes a main body 4351 and a connecting body 4353 projecting from the main body 4351. The connecting body 4353 includes a base 43531 and reinforcing bodies 43533 projecting from an outer side of the base 43531. A cross-section of the base 43531 may be approximately racetrack-shaped. The base 43531 and the reinforcing bodies 43533 are respectively fixed to the exhaust flange 433. Furthermore, more than two reinforcing bodies 43533 may be arranged on two opposite sides of the base 43531 or in a circumferential direction of the base 43531 to enhance the structural strength at a connection between the ventilation connector 435 and the exhaust flange 433.

Figure 16:
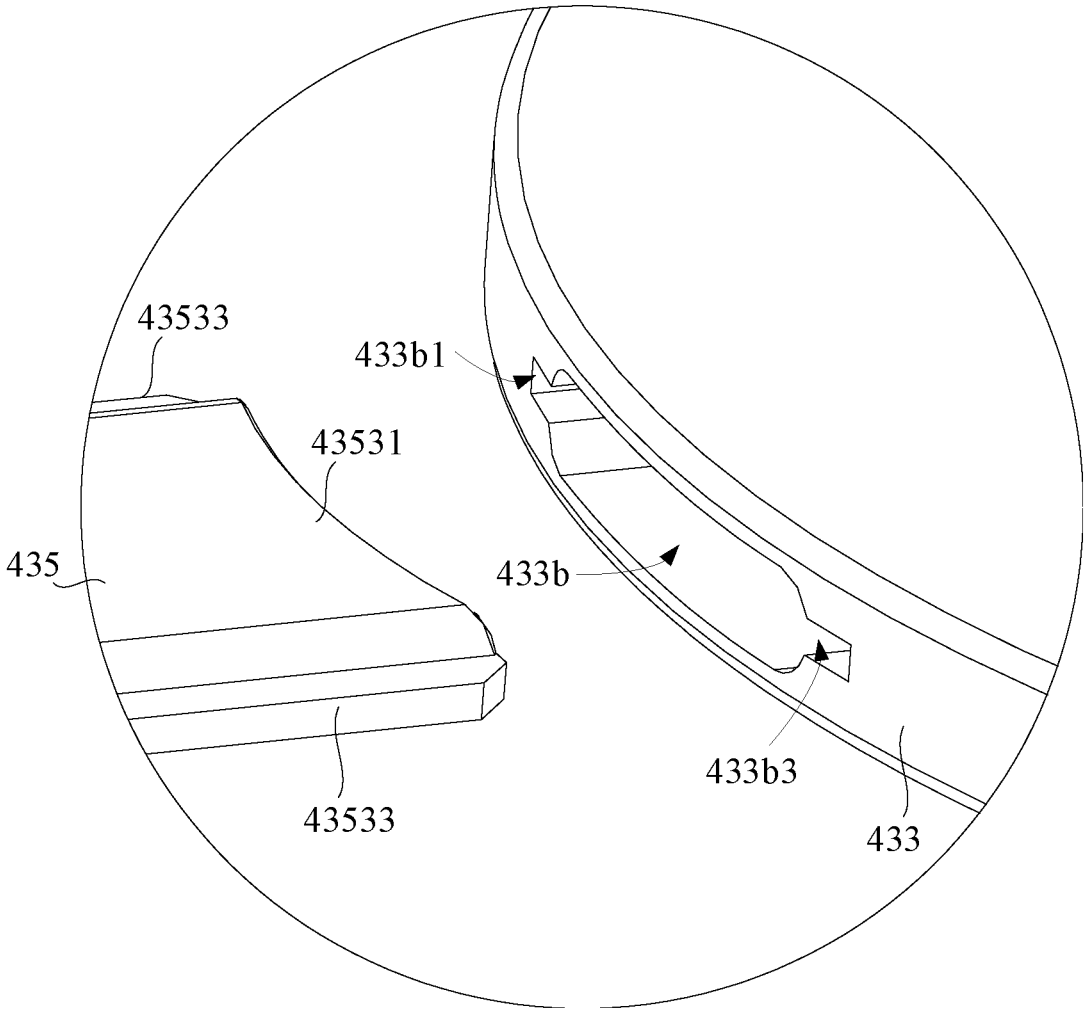
FIG. 16 is a schematic enlarged diagram of A of the fit of the toilet deodorization device and the toilet shown in FIG. 12.

Also in conjunction with FIG. 16, shapes of the first mounting groove 433*b*1 and the second mounting groove 433*b*3 match shapes of the reinforcing bodies 43533 of the ventilation connector 435. A wall thickness of the exhaust flange 433 corresponding to the reinforcing body 43533 is greater than that corresponding to the base 43531, so that a fit between the reinforcing body 43533 and the exhaust flange 433 can better share the stress at the connection between the ventilation connector 435 and the exhaust flange 433, thereby improving the structural strength of their connection.

Reference may be made to FIGS. 6 and 7 in the first embodiment for a cross-section of the reinforcing body 43533. The reinforcing bodies 43533 may project from the two opposite sides of the base 43531 along a width direction of the base 43531, or more than four reinforcing bodies 43533 may be arranged at intervals along the circumferential direction of the base 43531. Certainly, in other implementations, the reinforcing bodies 43533 may have other variants.

Figure 15:
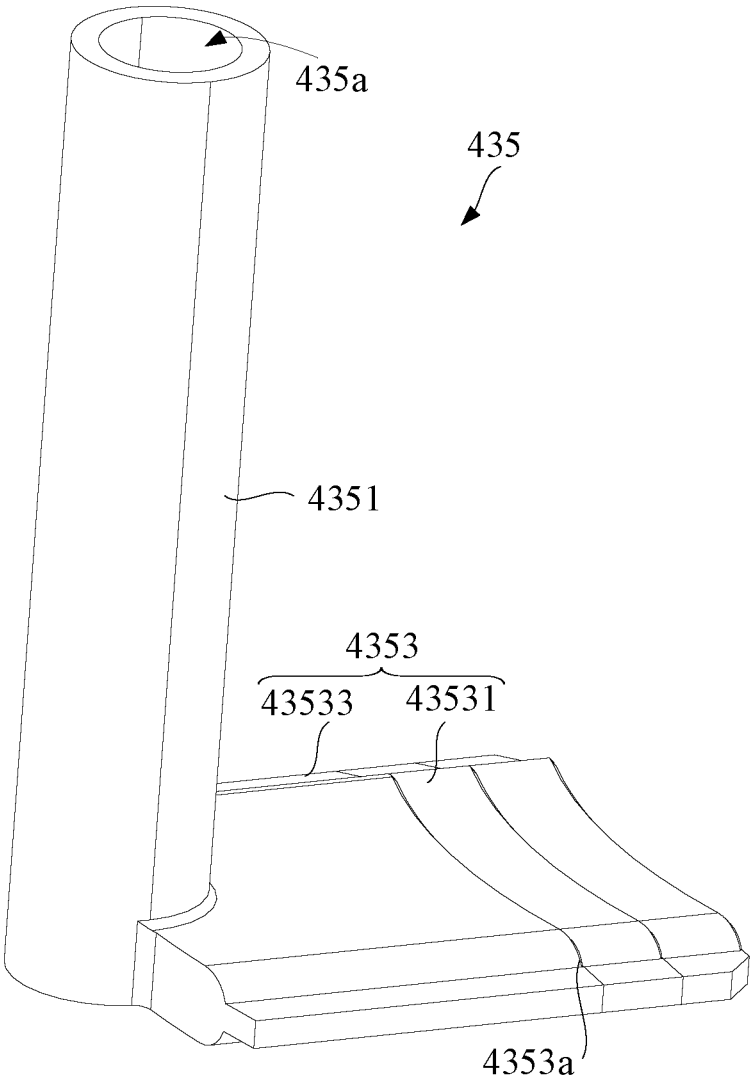
FIG. 15 is a schematic diagram of a pipe connector of one embodiment of the ventilation and drainage assembly of the toilet deodorization device in the second embodiment.

With continued reference to FIG. 15, in some implementations, the connecting body 4353 has nicks 4353*a* which may extend fully or partially around a periphery of the connecting body 4353 or may be discontinuous, so as to facilitate cutting to adjust a length of the connecting body 4353. In other words, in such implementations, the connecting body 4353 of the ventilation connector 435 may be relatively long when manufactured, but a size of the exhaust flange 433 can be adaptively adjusted for the toilet 50 and the toilet sewage pipe 63 with different sizes and structural arrangements, and therefore, a length of the exhaust passage 433*b* may also vary. By providing the nicks 4353*a* on the connecting body 4353, users can be conveniently guided to adjust the length of the connecting body 4353, thereby facilitating assembly of the ventilation and drainage assembly 43. Certainly, in other implementations, the nicks 4353*a* may only be provided on the reinforcing bodies 43533 on the two opposite sides of the connecting body 4353.

Figure 17:
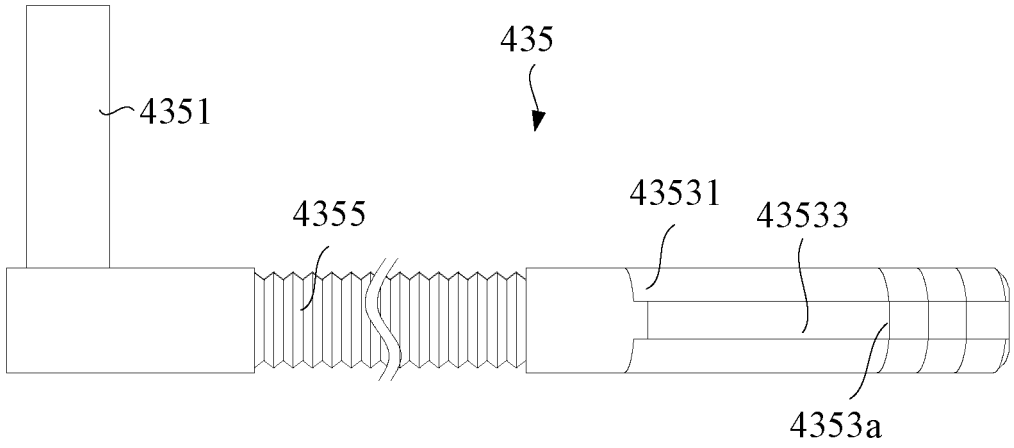
FIG. 17 is a schematic diagram of another type of pipe connector of the ventilation and drainage assembly in the second embodiment.

In some implementations, at least one of the main body 4351 and the connecting body 4353 of the ventilation connector 435 is deformable and configured to extend from a bottom of the toilet 50 for connection. Exemplarily, referring to FIG. 17, the ventilation connector 435 has a deformable section 4355, a length of which is not limited. A space for allowing the ventilation connector 435 to extend exists between the bottom of the toilet 50 and a mounting floor 61. The deformable section 4355 of the deformable ventilation connector 435 can be stretched, compressed, bent, or otherwise deformed to enable the ventilation connector 435 to extend from the bottom of the toilet 50 without cutting the toilet 50 itself, so that the existing toilet 50 can be conveniently retrofitted, thus improving convenience of use and reducing a deodorization retrofit cost of the toilet 50.

Specifically, in some implementations, a position of the toilet mounting hole 23*a* shown in FIG. 1 of the first embodiment on the toilet base 23 is not fixed. For example, in some toilets, generally, the toil mounting hole 23*a* may be differently positioned relative to the sewage passage 30*a*. For this situation, the deformable section 4355 can be lengthened or shortened properly to match the position of the toilet mounting hole 23*a*, thereby improving assembly convenience. Certainly, for toilets without the toilet mounting hole 23*a*, the deformable section 4355 can be lengthened until the air passage 435*a* is exposed outside the toilet base 23, thereby facilitating mounting of the ventilation pipe 437 and the ventilation connector 435. A bellows pipe is one form of such a telescopically deformable ventilation pipe 437.

Figure 14:
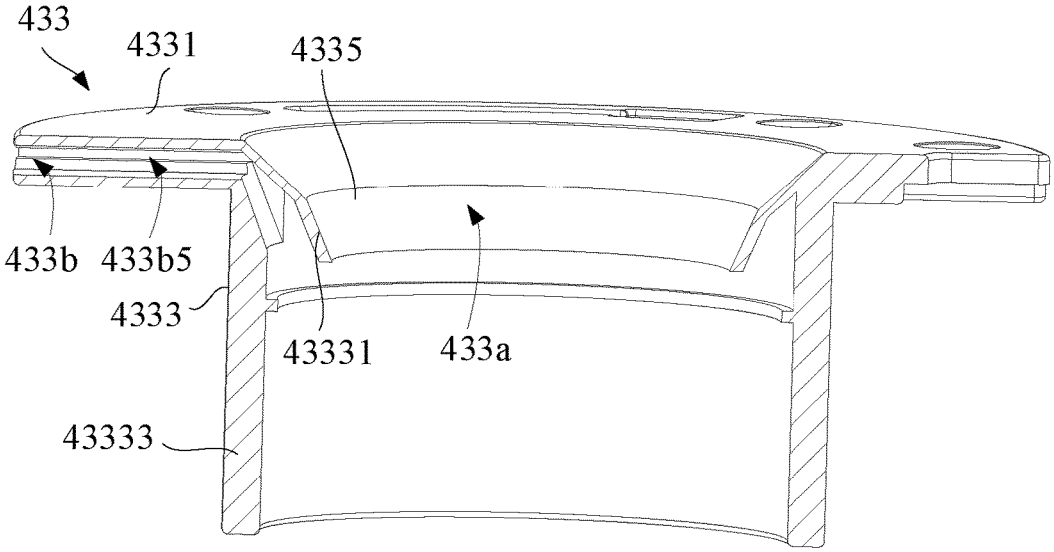
FIG. 14 is a sectional view of the exhaust flange shown in FIG. 13.

Similar to the first embodiment, referring to FIG. 14, the exhaust flange 433 in the second embodiment may also include a flange body 4331 and an extension portion 4333 convexly arranged on one side of the flange body 4331. Along an axial direction of the exhaust flange 433, the sewage passage 433*a* extends from the flange body 4331 to the extension portion 4333. The base 43531 and the reinforcing body 43533 are fixedly connected to a circumferential side of the flange body 4331. The extension portion 4333 has an exhaust groove 433*b*5 extending to a side opposite to the flange body 4331. That is, the exhaust groove 433*b*5 extends to one axial side of the extension portion 4333. The exhaust groove 433*b*5 is in communication with the air passage 435*a* and forms at least a part of the exhaust passage 433*b*. Reference may be made to the first embodiment for the structures of the flange body 4331, the extension portion 4333, and the exhaust groove 433*b*5 which are not repeated here.

Similar to the first embodiment, the exhaust groove 433*b*5 of the second embodiment may also be spaced apart from the sewage passage 433*a*, and a central angle corresponding to the exhaust groove 433*b*5 is not less than that corresponding to the air passage 435*a*. Moreover, the extension portion 4333 may include an inner ring 43331 and an outer ring 43333 connected to the flange body 4331. The outer ring 43333 surrounds the inner ring 43331, and the outer ring 43333 and the inner ring 43331 together define the exhaust groove 433*b*5. In other implementations, the exhaust passage 433*b* may extend along the interior of the flange body 4331 to a side wall 4335 of the sewage passage 433*a* to be in direct communication with the sewage passage 433*a* (see FIG. 11); or the side wall 4335 of the sewage passage 433*a* may be provided with a blocking portion 1336 similar to that in the first embodiment (see FIG. 10). These structures are not repeated here. Reference may be made to the first embodiment for other detailed structures of the exhaust flange 433 which are not repeated here.

Reference may be made to the first embodiment for other detailed structures of the second embodiment which are not repeated here.

In FIG. 12, the toilet sewage pipe 63 is not provided with a toilet mounting flange. The exhaust flange 433 may be directly connected to the toilet sewage pipe 63, and the connection includes, but is not limited to, tight fit insertion, glue connection, or rubber ring sealing connection. For example, in conjunction with FIGS. 13 and 14, when the exhaust flange 433 is directly connected to the toilet sewage pipe 63 by glue, the outer ring 43333 may protrude beyond the inner ring 43331 along the axial direction of the exhaust flange 433. In this type of connection, when an inner diameter of the toilet sewage pipe 63 is relatively large, the outer ring 43333 can be inserted into the toilet sewage pipe 63 and fixedly connected to the mounting floor 61 by the flange body 4331. When the outer diameter of the toilet sewage pipe 63 is relatively small, the outer ring 43333 may sleeve the toilet sewage pipe 63.

It should be understood that the above docking manners are applicable to different application scenarios in all embodiments. That is, these docking manners are also applicable to the first and subsequent third embodiments, which means that the assembly manner of the exhaust flange and the toilet mounting flange in the first and third embodiments can be replaced by the assembly manner of the exhaust flange 433 and the toilet sewage pipe 63 in the second embodiment.

Third Embodiment

Figure 18:
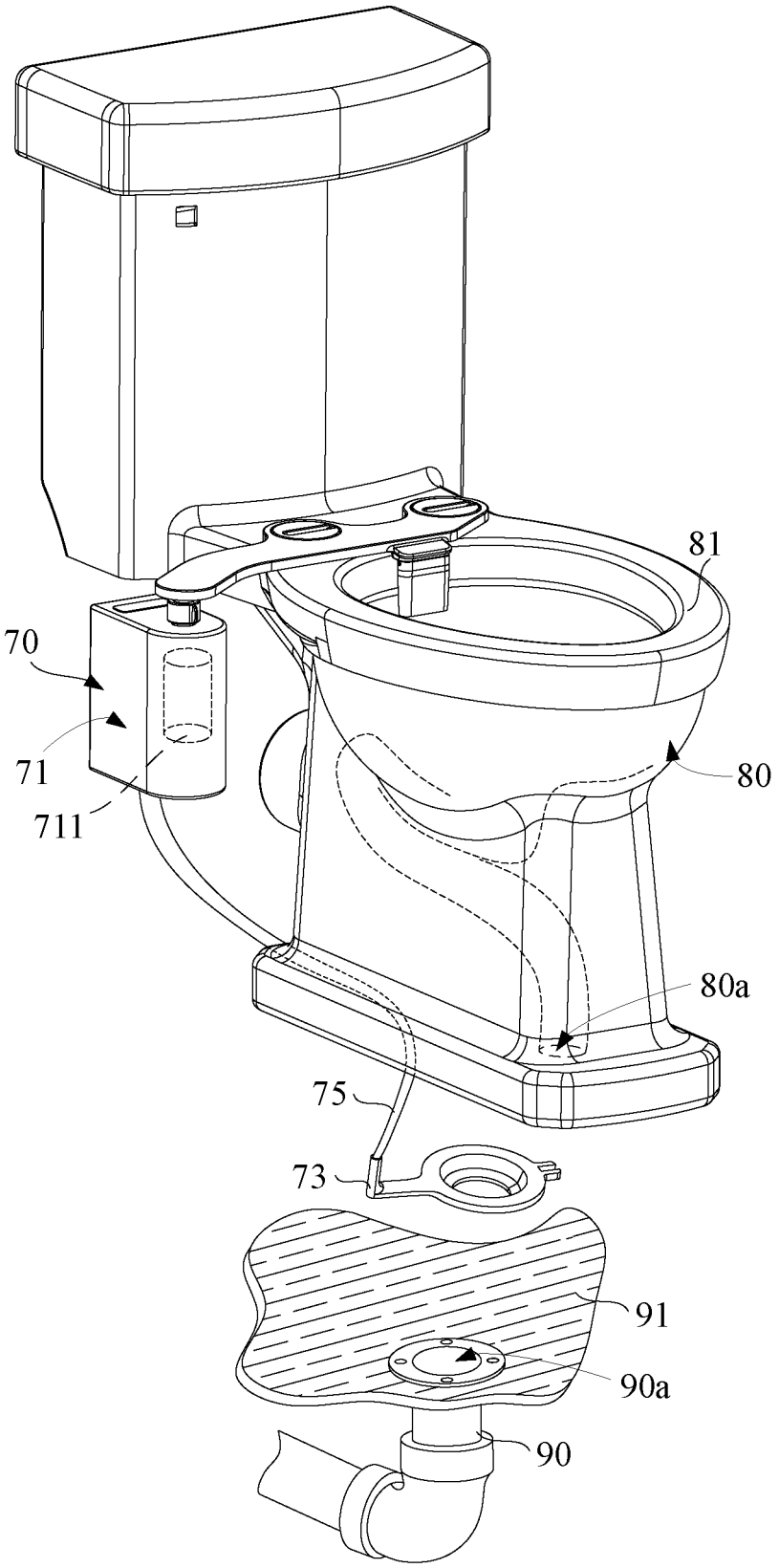
FIG. 18 is an exploded view of a fit of a toilet deodorization device and a toilet in a third embodiment.
Figure 19:
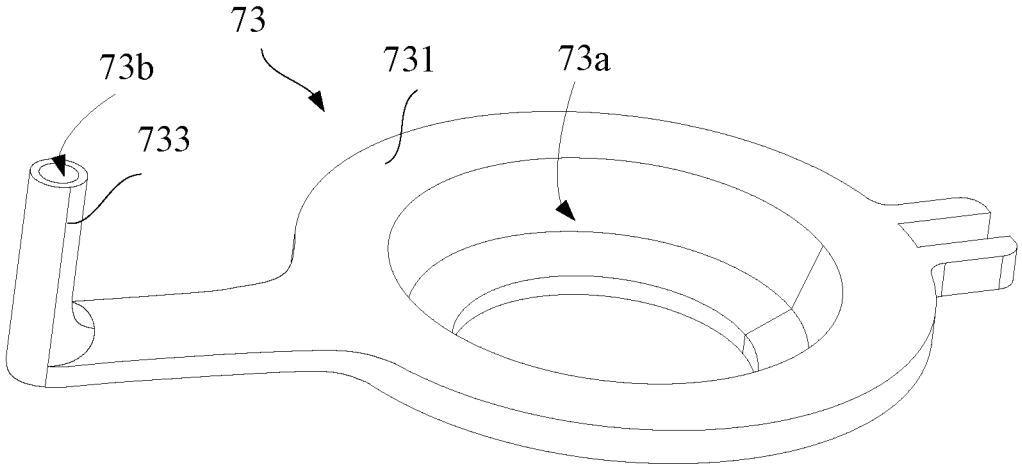
FIG. 19 is a schematic diagram of an exhaust flange shown in FIG. 18.

Referring to FIGS. 18 and 19, a third embodiment of the present application discloses a toilet deodorization device 70, which includes a suction mechanism 71 and an exhaust flange 73. The suction mechanism 71 can be mounted on a toilet bowl 81 of a toilet 80. The suction mechanism 71 includes a fan assembly 711 which can be in communication to the toilet bowl 81 through a hollow pipe or another hollow attachment, thus enabling air to flow between the toilet bowl 81 and the fan assembly 711. The exhaust flange 73 is arranged between a toilet sewage outlet 80*a* and a sewage passage 90*a*, and is in communication to the fan assembly 711. That is, the air can flow between the exhaust flange 73 and the fan assembly 711. The fan assembly 711 may include a motor which, when in operation, can induce airflow to draw the air from the toilet bowl 81 and guide it into the sewage passage 90*a* through the exhaust flange 73, thereby expelling odors in the toilet bowl 81 into the sewage passage 90*a* and preventing the odors in the toilet 80 from spreading into a restroom. It should be understood that in some implementations, the suction mechanism 71 may be integrated into a toilet lid or other parts of the toilet 80. In such implementations, the toilet lid or other parts with a deodorizing function may be considered as at least a part of the toilet deodorization device 70.

Different from the second embodiment, the exhaust flange 73 in the third embodiment includes a body 731 and a pipe connector 733 which are integrally formed. The body 731 has a sewage passage 73*a* configured to be in communication with the toilet sewage outlet 80*a*. The exhaust flange 73 also has an exhaust passage 73*b* extending from the pipe connector 733 to the body 731 and configured to guide gases into a toilet sewage pipe 90. The fan assembly 711 of the toilet deodorization device 70 can be in communication with the pipe connector 733 of the exhaust flange 73 through a ventilation pipe 75 to guide the air in the toilet bowl 81 into the sewage passage 90*a* through the exhaust flange 73. Reference may be made to the first and second embodiments for the arrangement of the exhaust passage 73*b* in the body 731 which is not repeated here.

In this implementation, since the pipe connector 733 and the body 731 are integrally formed, compared to the assembling and fixing manners of the first and second embodiments, the connection structure of a connection part between the body 731 and the pipe connector 733 is simplified, and the structural strength of the connection part can also be ensured. For example, it is easier to add reinforcing ribs at the connection part between the body 731 and the pipe connector 733, thus more easily improving the structural strength of the connection part. Furthermore, because the pipe connector 733 and the body 731 are integrally formed, internal sizes of the exhaust passage 73*b* at the connection of the pipe connector 733 and the body 731 can be larger, and the interior thereof can be more easily molded into a smoothly transitioned curved surface to reduce wind resistance, thereby facilitating the air in the toilet bowl 81 to enter the sewage passage 90*a* through the exhaust flange 73.

Figure 20:
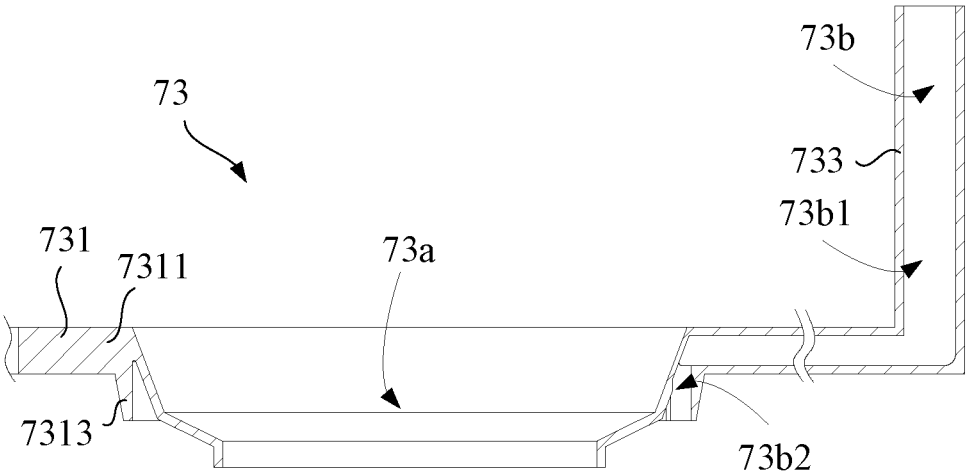
FIG. 20 is a sectional view of a first type of exhaust flange in the third embodiment.

Referring to FIG. 20, similar to the first embodiment, the body 731 may include a flange body 7311 and an extension portion 7313 convexly arranged on one axial side of the flange body 7311. Along an axial direction of the body 731, the sewage passage 73*a* extends from the flange body 7311 to the extension portion 7313. The pipe connector 733 is convexly arranged on a circumferential side of the flange body 7311. The pipe connector 733 has a first passage 73*b*1, and the body 731 has an exhaust groove 73*b*2. The first passage 73*b*1 is in communication to the exhaust groove 73*b*2, and the first passage 73*b*1 and the exhaust groove 73*b*2 together form at least a part of the exhaust passage 73*b*.

Similar to the first embodiment, the exhaust groove 73*b*2 can extend along the interior of the flange body 7311 to one axial side of the extension portion 7313, i.e., a side opposite to the flange body 7311, which is not repeated here. The first passage 73*b*1 extends along the interior of the pipe connector 733. An axial direction of the pipe connector 733 can be substantially parallel to or at an angle relative to the axial direction of the body 731. The pipe connector 733 is configured to be connected with a ventilation pipe 75, so that the first passage 73*b*1 is in communication to the fan assembly 711, and the exhaust groove 73*b*2 is thereby in communication to the fan assembly 711 through the first passage 73*b*1, which is not repeated here.

Figure 21:
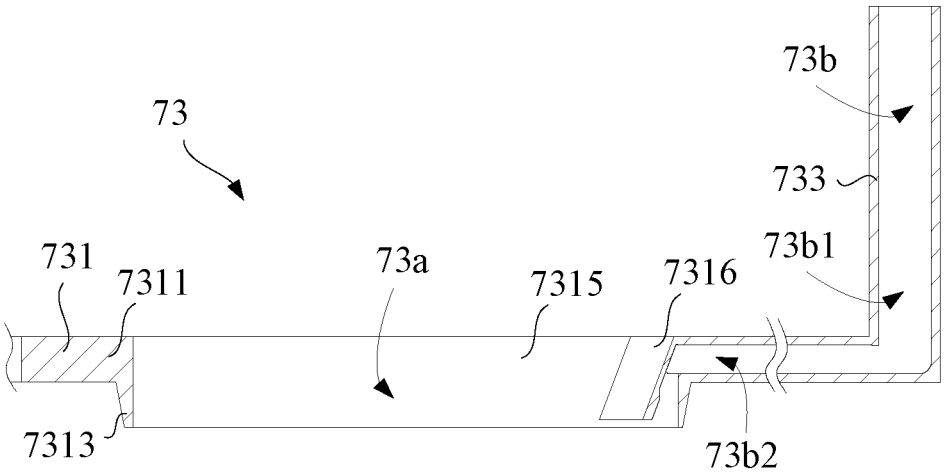
FIG. 21 is a sectional view of a second type of exhaust flange in the third embodiment.

With continued reference to FIG. 20, similar to the first embodiment, the exhaust groove 73*b*2 is spaced apart from the sewage passage 73*a* to prevent sewage from the toilet sewage outlet 80*a* from easily entering the exhaust passage 73*b*. Referring to FIG. 21, in other implementations, the body 731 has a side wall 7315 for defining the sewage passage 73*a*, and a blocking portion 7316 connected to the side wall 7315. The blocking portion 7316 is configured to prevent the sewage from entering the exhaust passage 73*b*. Specifically, the exhaust passage 73*b* can extend through the flange body 7311, and the blocking portion 7316 is arranged at a position corresponding to an outlet of the exhaust passage 73*b* on an inner side of the flange body 7311. The blocking portion 7316 may protrude from the side wall 7315 of the sewage passage 73*a* to prevent the sewage of the toilet sewage outlet 80*a* from easily entering the exhaust passage 73*b*. Certainly, in some variant implementations, the exhaust passage 73*b* may extend through the extension portion 7313 along a lateral or radial direction of the flange body 7311, and the blocking portion 7316 is arranged at a position corresponding to an outlet of the exhaust passage 73*b* on an inner side of the extension portion 7313 to prevent the sewage of the toilet from easily entering the exhaust passage 73*b*.

Figure 22:
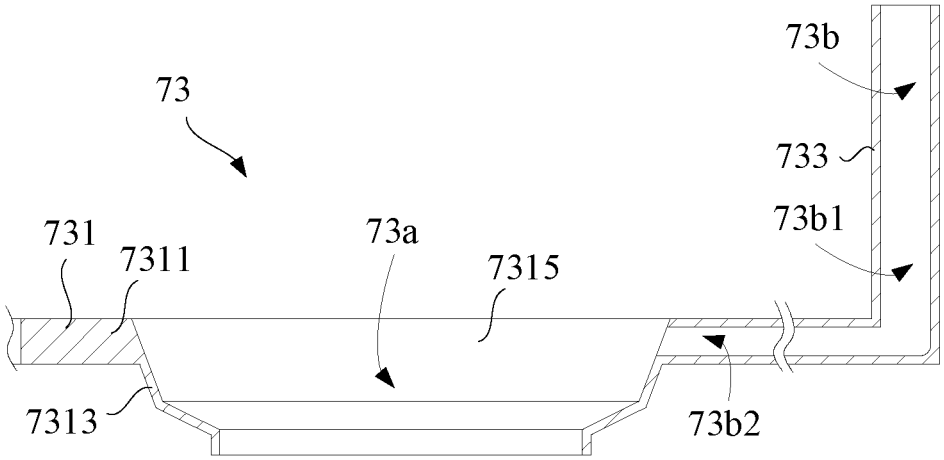
FIG. 22 is a sectional view of a third type of exhaust flange in the third embodiment.

Referring to FIG. 22, in other implementations, the body 731 has a side wall 7315 for defining the sewage passage 73*a*. The exhaust passage 73*b* extends to the side wall 7315 along the lateral or radial direction of the flange body 7311, so as to be in communication with the sewage passage 73*a*. In other words, in this implementation, the exhaust passage 73*b* does not need to be spaced apart from the sewage passage 73*a* of the exhaust flange 73, and no blocking portion 7316 is necessary. The air in the toilet bowl 81 can directly flow through the first passage 73*b*1 of the pipe connector 733 and the exhaust groove 73*b*2 of the body 731 into the sewage passage 73*a*. This structure can simplify the structure of the exhaust passage 73*b* of the exhaust flange 133, and facilitates manufacturing and molding of the exhaust flange.

Figure 23:
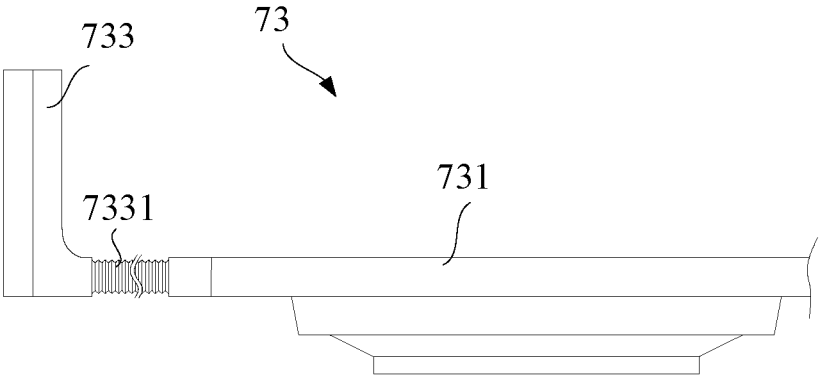
FIG. 23 is a schematic diagram of a fourth type of exhaust flange in the third embodiment.

Referring to FIG. 23, in the third embodiment, the pipe connector 733 may also have a deformable section 7331 for extending out from a bottom of the toilet 80 for connection. A length of the deformable section 7331 is not limited. A space for allowing the pipe connector 733 to extend exists between the bottom of the toilet 80 and a mounting floor 91. The deformable section 7331 of the deformable pipe connector 733 can be stretched, compressed, bent, or otherwise deformed to enable the pipe connector 733 to extend from the bottom of the toilet 80 without cutting the toilet 80 itself, so that the existing toilet 80 can be conveniently retrofitted, thus improving convenience of use and reducing a deodorization retrofit cost of the toilet 80. Reference may be made to the second embodiment for the detailed structure of the deformable section 7331 which is not repeated here.

Although the present invention has been illustrated and described through preferred embodiments and several alternative solutions, it is not limited to the specific descriptions contained in this specification. Other alternative or equivalent assemblies may be used to implement the present invention.

What is claimed is:

1. A ventilation connector used for a toilet deodorization device, comprising:

a main body having a first passage; and a connecting body protruding from a side of said main body and comprising a base and a reinforcing body projecting from an edge of said base, wherein said base has a second passage in communication with said first passage, and said second passage is configured to be in communication to a toilet sewage pipe; in an axial direction of said main body, a thickness of at least a part of said reinforcing body is smaller than that of said base; said connecting body is configured to be inserted into an exhaust passage of an exhaust flange, and a shape of said exhaust passage matches shapes of said base and said reinforcing body.

2. The ventilation connector according to claim 1, wherein said exhaust passage comprises a first mounting groove and second mounting grooves in communication with each other, said second mounting grooves are arranged on two side edges of said first mounting groove in a width direction, wherein the reinforcing body is two reinforcing bodies projecting from two opposite sides of said base in a one-to-one correspondence, a shape of said base matches a shape of said first mounting groove, and shapes of said reinforcing bodies match shapes of said second mounting grooves.

3. An exhaust flange used for a toilet deodorization device, having a sewage passage and an exhaust passage, wherein said sewage passage is configured to be in communication with a toilet sewage outlet, said exhaust passage is configured to guide gases into a toilet sewage pipe and to accommodate insertion of a ventilation connector, and comprises a first mounting groove and a second mounting groove that are in communication with each other, and said second mounting groove is located at an edge of said first mounting groove along a width direction; in an axial direction of said exhaust flange, a flange wall thickness at said second mounting groove is greater than that at said first mounting groove, a shape of said first mounting groove matches that of a base of said ventilation connector, and a shape of said second mounting groove matches that of a reinforcing body of said ventilation connector.

4. The exhaust flange according to claim 3, comprising a flange body and an extension portion projecting from one axial side of said flange body, wherein along an axial direction of said exhaust flange, said sewage passage extends from said flange body to said extension portion, said first mounting groove and said second mounting groove are formed in a circumferential side of said flange body, said exhaust passage comprises an exhaust groove in communication to said first mounting groove and said second mounting groove, and said exhaust groove extends to one axial side of said extension portion.

5. The exhaust flange according to claim 4, wherein said exhaust groove is spaced apart from said sewage passage.

6. The exhaust flange according to claim 4, wherein said extension portion comprises an inner ring and an outer ring connected to said flange body, said outer ring surrounds said inner ring, and said outer ring and said inner ring define said exhaust groove.

* * * * *